US007735244B1

(12) United States Patent
Ameche

(10) Patent No.: US 7,735,244 B1
(45) Date of Patent: Jun. 15, 2010

(54) PORTABLE TRAVEL FOOTWEAR

(76) Inventor: H. Kathleen Ameche, 230 W. Superior St., Suite #500, Chicago, IL (US) 60610

( * ) Notice: Subject to any disclaimer, the term of this patent is extended or adjusted under 35 U.S.C. 154(b) by 651 days.

(21) Appl. No.: 11/701,849

(22) Filed: Feb. 2, 2007

Related U.S. Application Data

(60) Provisional application No. 60/765,018, filed on Feb. 2, 2006.

(51) Int. Cl.
*A43B 1/10* (2006.01)

(52) U.S. Cl. ..... 36/102; 36/9 R

(58) Field of Classification Search ..... 36/100, 36/102, 103, 138, 9 R
See application file for complete search history.

(56) References Cited

U.S. PATENT DOCUMENTS

| | | | | | |
|---|---|---|---|---|---|
| 905,432 | A | * | 12/1908 | Jennings | 36/102 |
| 1,861,844 | A | * | 6/1932 | Dodge et al. | 36/18 |
| 2,490,916 | A | * | 12/1949 | Miller | 36/9 R |
| 3,102,271 | A | * | 9/1963 | Wilkerson | 2/239 |
| 3,724,107 | A | * | 4/1973 | Makinen et al. | 36/7.3 |
| 4,246,707 | A | * | 1/1981 | Pedersen | 36/100 |
| 4,554,749 | A | | 11/1985 | Ostrander | |
| 4,608,769 | A | * | 9/1986 | Sturlaugson | 36/68 |
| 5,033,144 | A | | 7/1991 | Ganon | |
| 5,481,814 | A | | 1/1996 | Spencer | |
| 5,617,585 | A | | 4/1997 | Fons et al. | |
| 5,930,916 | A | | 8/1999 | Connor | |
| 6,189,239 | B1 | * | 2/2001 | Gasparovic et al. | 36/102 |
| 6,298,583 | B1 | * | 10/2001 | Allen | 36/100 |
| 6,308,438 | B1 | | 10/2001 | Throneburg et al. | |
| 6,665,883 | B2 | | 12/2003 | Sloan | |
| 6,836,976 | B2 | | 1/2005 | Haugland | |
| 6,857,203 | B2 | | 2/2005 | Minden | |
| 6,877,252 | B2 | | 4/2005 | Wilkinson | |
| 6,931,762 | B1 | | 8/2005 | Dua | |
| 7,032,327 | B1 | * | 4/2006 | Tartaglia et al. | 36/11.5 |
| 7,162,813 | B2 | * | 1/2007 | Haft | 36/9 R |
| 7,168,190 | B1 | * | 1/2007 | Gillespie | 36/102 |
| 2004/0088890 | A1 | * | 5/2004 | Matis et al. | 36/138 |
| 2006/0242862 | A1 | * | 11/2006 | Chelani | 36/114 |

* cited by examiner

*Primary Examiner*—Marie Patterson
(74) *Attorney, Agent, or Firm*—McDonnell Boehnen Hulbert & Berghoff LLP

(57) ABSTRACT

The portable travel footwear and method of the present invention overcomes the limitations of footwear of the prior art by providing improved portable travel footwear, that is durable, flexible, elastic, and lightweight. The portable travel footwear protects bare or socked feet from dirty, cold and/or wet floor environments during travel. The present invention can quickly and easily knock-down to fit within small spaces and is quickly and easily erected to fit securely over a foot of any size and/or shape. The portable travel footwear is lightweight so not to burden a traveler with additional weight, to already heavy luggage, for the traveler to carry.

11 Claims, 3 Drawing Sheets

PORTABLE TRAVEL FOOTWEAR

This application claims benefit of U.S. Provisional Application No. 60/765,018, filed Feb. 2, 2006.

FIELD OF THE INVENTION

This invention relates to footwear in general, and more particularly to a portable travel footwear, such as a shoe or slipper, that is durable, flexible, elastic, lightweight and capable of being manipulated between an erected state, for wear, and a knock-down state, for storing during travel.

BACKGROUND OF THE INVENTION

With increased security in the mass transportation industry, including airline, train and bus, passengers are required to remove footwear to pass through security check points. It is not desirable to remove footwear to expose bare feet or feet with socks or nylon stockings to a wet, cold, dirty floor environment. A wet, cold and/or dirty floor environment prevents a person from comfortably walking through security checkpoints.

Additionally, with the long waiting times in security lines due to increased travelers and extensive security inspections, it is desirable for a traveler to be ready, e.g., footwear removed, to pass through a security checkpoint. Removing footwear prior to a traveler's turn through a security checkpoint saves time and decreases overall waiting times in security lines.

If a traveler desires to remove footwear just prior to their turn at a security checkpoint, it is desirable to have portable footwear that is quick and easy to put on. It is further desirable to have footwear that is flexible such that it is quickly and easily transformed into a knock-down state, to fit within small spaces, such as a pocket or purse, making the footwear readily at hand.

Besides situations such as security lines or other public places where regular footwear may need to be removed, there are other environments where barefoot walking may not be desired, such as an airplane cabin or a hotel room, or a religious establishment or the like where footwear is not permitted.

There does, of course, exist footwear, including shoes, oversocks and slippers. Other footwear includes those as described in U.S. Pat. No. 6,665,883 to Sloan, U.S. Pat. No. 6,308,438 to Throneburg, U.S. Pat. No. 6,931,762 to Dua. While this prior art footwear provides protection, there are certain shortcomings.

The footwear of Sloan and Throneburg has leg portions that fit over the calf of a person, while the footwear of Dua includes a securing system, or strap, that must be assembled. This footwear is not adapted to be quickly and easily put on or taken off in timely situations.

The footwear of both Dua and Throneburg is further constructed from bulky thick materials, such that they are not flexible to be easily knock-down for storing within small spaces. Additionally, this footwear must be tailored to a specific foot size.

Thus, there is a need for providing travelers with portable travel footwear that is durable, as to not tear or rip and to protect bare or socked feet, while also being waterproof in the circumstance of a wet floor environment. The portable travel footwear must also be flexible, such that it is quickly and easily transformed into a knock-down state (from an erected state) to fit within small spaces, while easily accessed when required. There is a further need for providing travelers with portable travel footwear that is elastic to fit securely over varying contours of travelers bare or socked feet. There is also a need for providing travelers with portable travel footwear that is lightweight so that the footwear does not add any additional weight, to already heavy luggage, for the traveler to carry. Additionally, making the portable travel footwear readily movable and usable between any such other baggage would be even better.

SUMMARY OF THE INVENTION

The portable travel footwear of the present invention overcomes the limitations of footwear of the prior art by providing improved portable travel footwear that is durable, flexible, elastic, and lightweight.

The portable travel footwear according to the present invention comprises a base portion, heel portion and toe portion. The base potion includes a sole surface and floor surface. It is further contemplated that the sole surface of the base portion can include an insole support. Additionally, the floor surface of the base portion can be a non-slip surface.

As assembled, the heel portion and toe portion are connected along the exterior edge of the base portion, to form a heel interior and toe interior, respectively. The heel interior and toe interior form a receptacle for receiving a foot. The portable travel footwear is constructed from a flexible material, such that it can be foldable about more than one hinge point between an erected state and a knock-down state. In one embodiment, the portable travel footwear is folded about one hinge point such that the heel interior of the heel portion collapses within the toe interior of the toe portion. This knock-down state enables the portable travel footwear to fit within small spaces.

The carrier system of the present invention still further includes a looped tab. For purposes of this invention, the looped tab can releasably attach and detach (quickly and easily) the portable travel footwear from a base, i.e., something being carried by the user such as, a piece of luggage. For purposes of this application, the "something", or "base" article, can include a piece of luggage, jacket, purse, handbag, suitcase, briefcase, backpack, clothing, or other such items typically carried by a traveler. It is further contemplated that the looped tab can assist a traveler in putting on the portable travel footwear. The traveler can hold the tab to allow the foot to slip into the travel footwear without the heel portion buckling and without the traveler using a shoehorn or finger to facilitate putting the footwear on.

The portable travel footwear can be comprised of just about any suitable material, but preferably is opaque, durable and easy to clean, elastic, but with some rigidity, and most preferably flexible. It is further desired that the material construction of the portable travel footwear does not alarm at security checkpoints. In one preferred form, the portable travel footwear is manufactured from neoprene fabric. Neoprene is waterproof and sufficiently rigid to hold its form, while also protecting bare or socked feet received within the travel footwear. It is contemplated that the portable travel footwear may be constructed from any suitable material, e.g., latex, rubber, vinyl, Gore-tex, nylon, etc., providing the properties described herein.

The durability and flexibility of the portable travel footwear not only relates to the material from which it is constructed, but to the thickness of the material. The durability and thickness of the portable travel footwear are directly related, as increased thickness yields increased durability of the portable travel footwear.

The flexibility and thickness of the portable travel footwear are generally inversely related, as increased thickness yields decreased flexibility of the portable travel footwear, so thin travel footwear is considered most desirable. Thin footwear allows the portable travel footwear to be flexibly transformed into a knock-down state, but most preferably without compromising durability.

With the forgoing in mind, it is one object of the invention to provide improved portable travel footwear that is durable, as to not easily tear or rip, and which can be made very compact when not in use. Further, durable and waterproof travel footwear protects bare or socked feet from wet, cold and/or dirty floor environments while for example proceeding through security checkpoints during travel.

It is a further object of the invention to provide a portable travel footwear that is flexible, such that it is quickly and easily manipulated into a knock-down or folded state to fit within small spaces, while also being easily accessed and manipulated into an erected state, when required. Flexible footwear allows for multiple hinge points such that the footwear can be foldable in various knock-down states, or configurations.

It is a further object of the invention to provide portable travel footwear that is elastic. Feet, including socked feet, come in a variety of shapes and sizes. Elastic portable travel footwear allows for three sizes: small, medium and large, or even a "one-size-fits-all", without compromising a secure fit to varying contours and sizes of travelers' feet. An elastic portable travel footwear construction also allows for variations in natural foot flexion and movement during wear. Manufacturing portable travel footwear that conforms to a foot of any size or shape is less expensive than manufacturing individual footwear for each variation in the shape and size of a foot.

Another object of the invention is to provide travelers with portable travel footwear that is lightweight and easy to combine with hand luggage, a laptop computer case, jacket, purse, handbag, suitcase, briefcase, back pack, or other such items carried along during travel.

Additionally, it is a further object of the invention to provide a tab to readily attach to and detach from a variety of articles typically carrier by travelers. The tab allows the portable travel footwear to be readily movable and usable, while preventing the portable travel footwear from being misplaced, dropped or lost. For example, the portable travel footwear can be releasably contained in a portable carrier system, like that disclosed in U.S. patent application Ser. No. 11/331,251 entitled Portable Tethered Carrier and Method by H. Kathleen Ameche filed on Jan. 12, 2006.

The present invention and its attributes and advantages will be further understood, and appreciated with reference to the detailed description below of a presently contemplated embodiment, taken in conjunction with the accompanying drawings.

BRIEF DESCRIPTION OF THE DRAWINGS

The preferred embodiments of the invention will be described in conjunction with the appended drawings provided to illustrate, and not to the limit, the invention, where like designations denote like elements, and in which.

DETAILED DESCRIPTION OF THE PREFERRED EMBODIMENTS

The embodiments of the present invention described hereinafter have been particularly adapted for use in the mass, or public, transportation industry. The portable carrier device could easily be adapted for other environments or applications, without departing from the invention.

Figure 1:
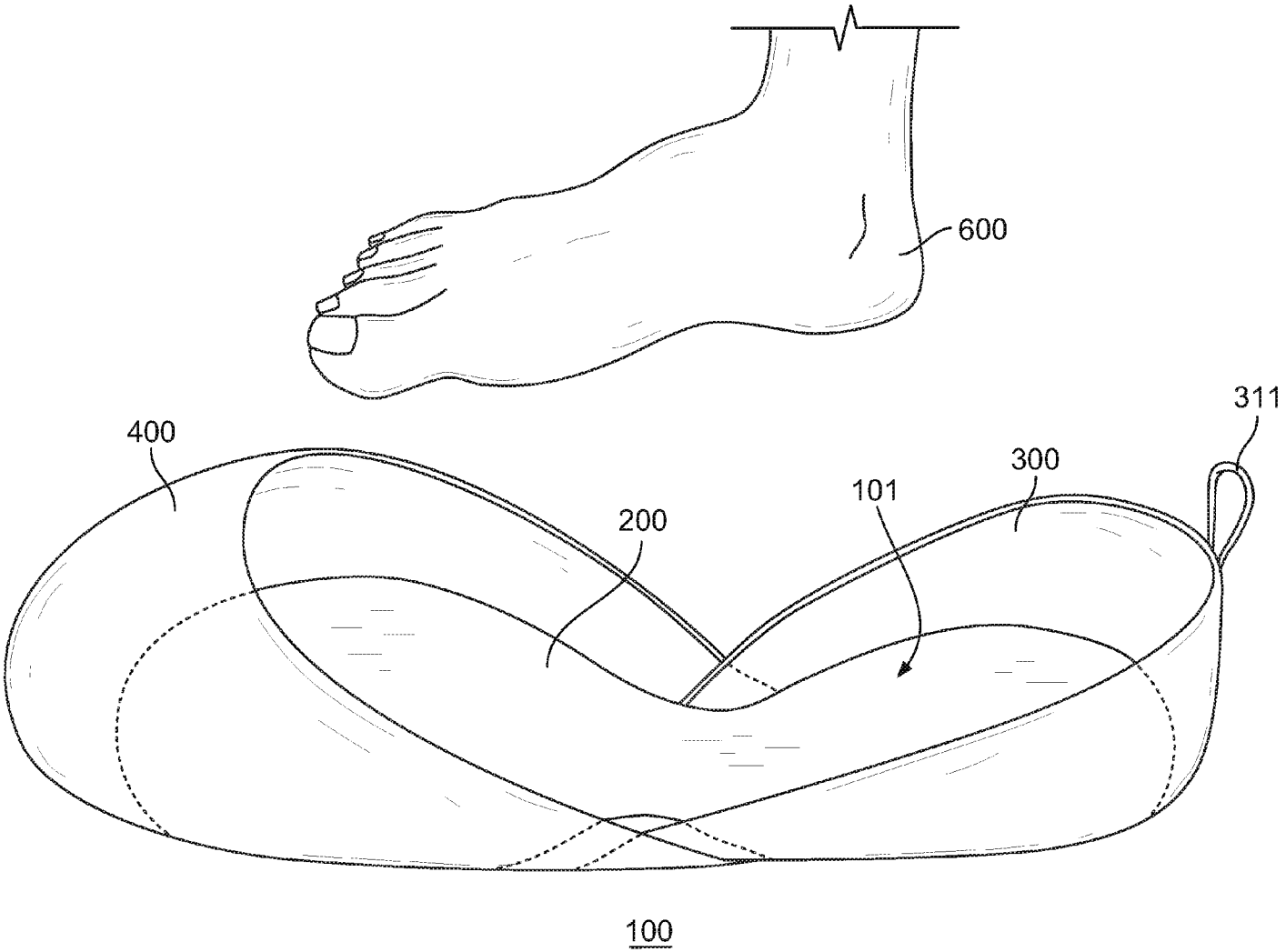
FIG. 1 illustrates a perspective view of one embodiment of portable travel footwear according to the present invention.

As shown in FIG. 1, the portable travel footwear 100 according to the present invention comprises a base portion 200, heel portion 300 and toe portion 400 forming a receptacle 101 for receiving a foot 600. Once in the receptacle 101, the sole of the foot 600 substantially abuts the base portion 200 while the heel and toe areas substantially abut the heel portion 300 and toe portion 400, respectively. The portable travel footwear 100 may further include a tab 311.

Figure 2:
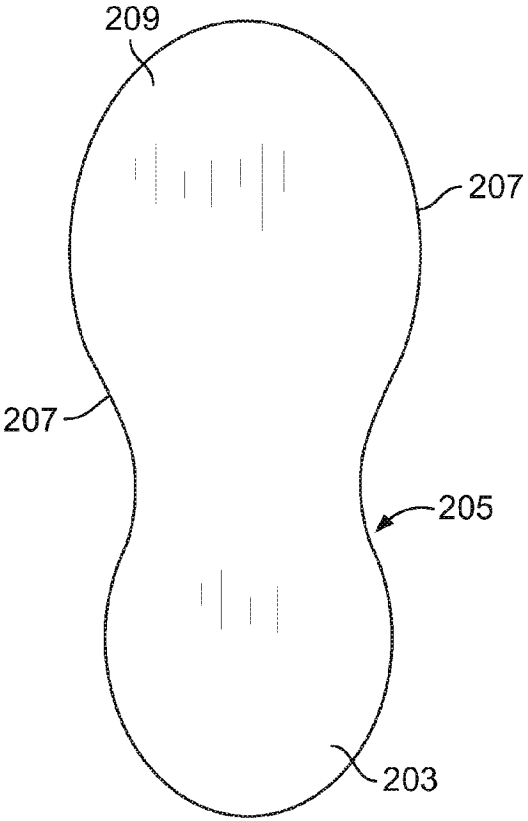
FIG. 2 illustrates a top view of the base portion of portable travel footwear according to the present invention.

The portable travel footwear 100 has a base portion 200, as shown in FIG. 2, with a sole surface 203 and a floor surface 205, both 203, 205 terminating at a continuous exterior edge 207. The base portion 200 has contour shaped like the sole, or bottom, of a foot. The base portion 200 can further include an insole support 209. The insole support 209 can be made of any well-known footwear material known to those skilled in the art, e.g., leather, suede, wood, cork, plastic, rubber, PVC, polyurethane, silicon, neoprene and the like.

Figure 3:
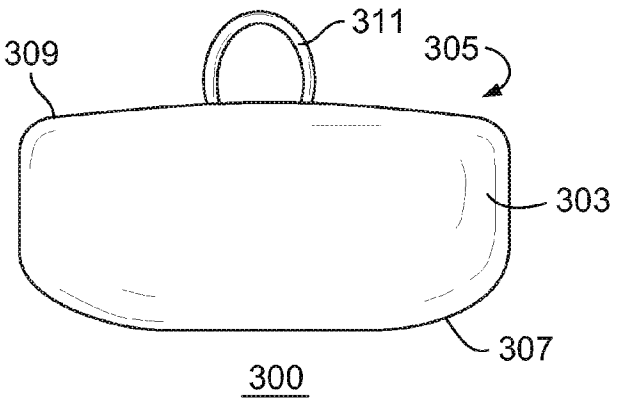
FIG. 3 illustrates an end view of the heel portion of portable travel footwear according to the present invention.

As illustrated in FIG. 3, the portable travel footwear 100 has a heel portion 300 with a first inner surface 303 and a first outer surface 305, both 303, 305 terminating between a first edge 307 and a second edge 309. The heel portion 300 has a contour shape to engage the heel area of a foot, once assembled to the base portion 200. The heel portion 300 may further include a looped tab 311. The tab 311 can be made of any material, including the same material of the travel footwear 100 that is capable to withstand connecting to a base. It is contemplated that the tab 311 can be connected to a releasable clasp or fastener which may be, for example, a snap hook, loop fastener, lobster clasp, snap-fit mechanism, Velcro®, magnet, or any other tab that quickly and easily is secured to or removed from a base article. The tab 311 is connected to the first inner surface 303 substantially near the second edge 309. The tab 311 can be connected by any method known in the art, for example, sewn, adhesive, Velcro®, welded, bond to name a few.

Figure 4:
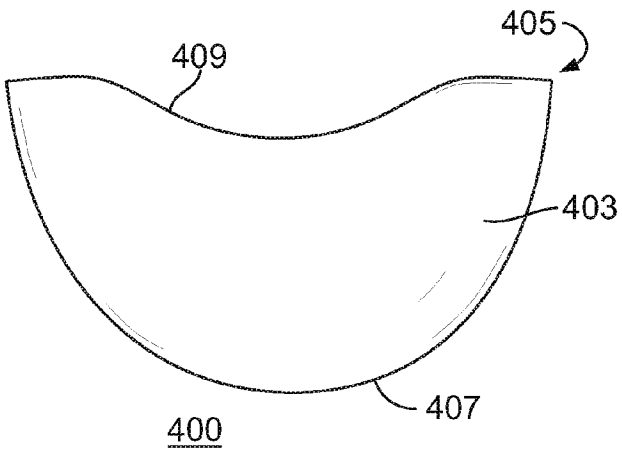
FIG. 4 illustrates a front view of the toe portion of portable travel footwear according to the present invention.

The portable travel footwear 100 has a toe portion 400, as shown in FIG. 4, with a second inner surface 403 and a second outer surface 405, both 403, 405 terminating between a third edge 407 and a fourth edge 409. The heel portion 400 has a contour shaped to engage the toe area of a foot, once assembled to the base portion 200.

Figure 5:
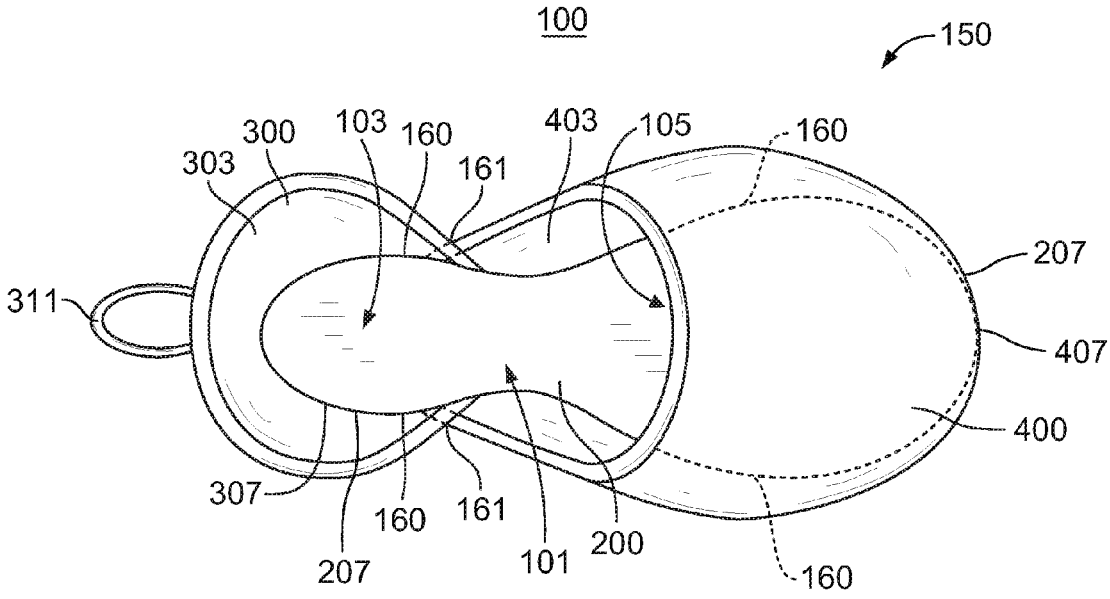
FIG. 5 illustrates a top view of assembled portable travel footwear according to one embodiment of the present invention.

FIG. 5 illustrates a top view of assembled portable travel footwear 100 in the erected state 150 according to one embodiment of the present invention. The heel portion 300 and toe portion 400 are connected along the exterior edge 207 of the base portion 200 to construct the portable travel footwear 100. The first edge 307 of the heel portion 300 is connected to the exterior edge 207 of the base portion 200 to form a heel interior 103, while the third edge 407 of the toe portion 400 is connected to the exterior edge 207 of the base portion 200 to form a toe interior 105. The heel interior 103 and toe interior 105 form receptacle 101 for receiving a foot. Once in the receptacle 101, the sole of a foot substantially abuts the base portion 200 while the heel and toe areas substantially abut the heel portion 300 and toe portion 400, respectively. More particularly, the heel area of a foot is received in the heel interior 103 and the toe area of a foot is received in the toe interior 105, such that the heel substantially abuts the first inner surface 303 of the heel portion 300 and the toe area substantially abuts the second inner surface 403 of the toe portion 400. The portable travel footwear 100 may further include a tab 311 to assist the traveler in putting on the footwear.

Figure 6:
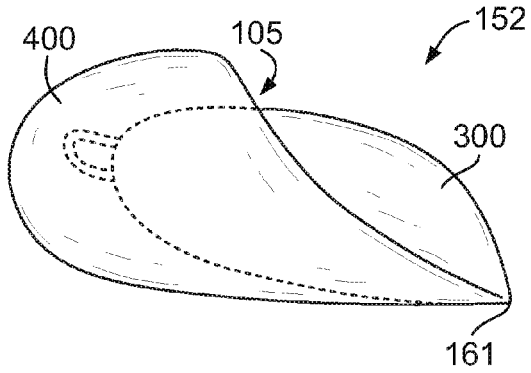
FIG. 6 illustrates a perspective view of a portable travel footwear in a knock-down state according to the present invention.

Because the portable travel footwear 100 is constructed from a flexible material, such as neoprene discussed above, it can be easily manipulated between an erected state 150, as seen in FIG. 5, and knock-down state 152, as seen in FIG. 6. As shown in FIG. 6, in a knock-down state 152, the portable travel footwear 100 is capable of fitting within small spaces. The flexibility of the material of the portable travel footwear 100 allows for multiple hinge points 160, as shown in FIG. 5. The hinge points 160 are opposed along the continuous exterior edge 207 of the base portion 200 to permit the portable travel footwear 100 to be foldable in various knock-down states 152. The portable travel footwear 100 can be foldable about one or more hinge points 160, dictated by the flexibility of the material construct of the portable travel footwear 100.

FIG. 6 illustrates a perspective view of portable travel footwear 100 in a knock-down state 152 according to the present invention. As shown in FIG. 6, the portable travel footwear 100 is folded about hinge point 161 such that the heel interior 103 of the heel portion 300 is collapsible within the toe interior 105 of the toe portion 400. This knock-down state 152 enables the portable travel footwear 100 to fit within small spaces, while also being easily manipulated into an erected state 150 (FIG. 5), when required.

Figure 7:
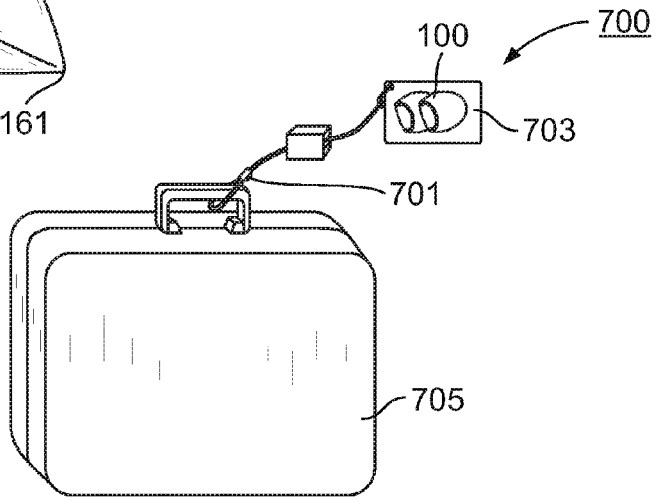
FIG. 7 illustrates a perspective view of portable travel footwear stowed in a portable carrier system.

In addition to assisting the traveler in putting on the footwear as discussed above, the looped tab 311 allows the portable travel footwear 100 to be readily movable and usable, while preventing the portable travel footwear 100 from being misplaced, dropped or lost. FIG. 7 shows the portable carrier footwear 100 in an erected state 150 (see FIG. 5) and releasable attached to a portable carrier system 700 (excluding luggage 705 shown), like that disclosed in U.S. patent application Ser. No. 11/331,251, the subject matter of which is incorporated herein by reference. As shown, the looped tab 311 of the portable travel footwear 100 of the present invention is connected to the anchoring element 701, but can be attached to the portable carrier system 700 at any attachment point or unifying element. It is further contemplated that the portable travel footwear 100 can be stowed within the enclosable carrier case 703 itself.

While the present invention has been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended Claims.

What is claimed is:

1. An improved portable travel footwear comprising:

a base portion, including a foot sole engaging surface and a floor engaging surface, both terminating at a continuous exterior edge, wherein said base portion further includes opposing hinge points along said exterior edge;

a heel portion, including a first inner surface and a first outer surface, both terminating between a first edge and a second edge; wherein said first edge of said heel portion is connected to said exterior edge of said base portion forming a heel interior;

a toe portion, including a second inner surface and a second outer surface, both terminating between a third edge and a fourth edge; wherein said third edge of said toe portion is connected to said exterior edge of said base portion forming a toe interior;

wherein said opposing hinge points are defined at a connection of said heel portion and said toe portion;

wherein said heel portion is sized and shaped to fit within said toe portion without reconfiguration;

said heel interior and said toe interior forming a receptacle, wherein said receptacle is sized and shaped to receive a foot; and said portable travel footwear is easily manipulated between at least one erected state and at least one knock-down state about one or more said opposing hinge points.

2. The improved portable travel footwear of claim 1 further comprising a tab on said heel portion.

3. The improved portable travel footwear of claim 2 wherein said tab is connected to said first inner surface of said heel portion substantially near said second edge.

4. The improved portable travel footwear of claim 2 wherein said tab is releasably attachable to a base.

5. The improved portable travel footwear of claim 4 wherein said base includes a portable carrier system.

6. The improved portable travel footwear of claim 1 further comprising an insole support on said sole surface of said base portion.

7. The improved portable travel footwear of claim 1 wherein said footwear is constructed from neoprene, with a non-slip floor engaging surface.

8. The improved portable travel footwear of claim 1 wherein said footwear is constructed from spandex.

9. An improved portable travel footwear comprising:

a base portion, including a sole surface and a floor surface, both terminating at a continuous exterior edge, wherein said base portion further includes opposing hinge points along said exterior edge;

an insole support, wherein said support is on said sole surface of said base portion;

a heel portion, including a first inner surface and a first outer surface, both terminating between a first edge and a second edge; wherein said first edge of said heel portion is connected to said exterior edge of said base portion forming a heel interior;

a toe portion, including a second inner surface and a second outer surface, both terminating between a third edge and a fourth edge; wherein said third edge of said toe portion is connected to said exterior edge of said base portion forming a toe interior;

wherein said opposing hinge points are defined at a connection of said heel portion and said toe portion;

a tab on said heel portion, wherein said tab is connected to said first inner surface of said heel portion substantially near said second edge and said tab is releasably attachable to a base;

said heel interior and said toe interior forming a receptacle, wherein said receptacle is sized and shaped to receive a foot such that a heel area of said foot is received in said heel interior of said receptacle and a toe area of said foot is received in said toe interior of said receptacle; and said portable travel footwear is easily manipulated between an erected state and a knock-down state about one or more said opposing hinge points, wherein said knock-down state includes said heel interior of said heel portion collapsible within said toe interior of said toe portion about one of said opposing hinge points and wherein said heel portion is sized and shaped to fit within said toe portion without reconfiguration.

10. The improved portable travel footwear of claim 9 wherein said footwear is constructed from neoprene.

11. The improved portable travel footwear of claim 9 wherein said footwear is constructed from spandex.

* * * * *